US007478594B1

(12) United States Patent
Chen et al.

(10) Patent No.: US 7,478,594 B1
(45) Date of Patent: Jan. 20, 2009

(54) LASER PRIMER

(75) Inventors: Gary Chen, Succasunna, NJ (US); Daniel O. Gutierrez, Kresgeville, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 186 days.

(21) Appl. No.: 11/551,736

(22) Filed: Oct. 23, 2006

(51) Int. Cl.
*F42C 19/08* (2006.01)

(52) U.S. Cl. ..... 102/201
(58) Field of Classification Search ..... 102/201
See application file for complete search history.

(56) References Cited

U.S. PATENT DOCUMENTS

| | | | | |
|---|---|---|---|---|
| 6,460,460 | B1 * | 10/2002 | Jasper et al. | 102/201 |
| 6,467,803 | B2 * | 10/2002 | Dirmeyer et al. | 280/731 |
| 6,470,801 | B1 * | 10/2002 | Swart et al. | 102/201 |
| 6,539,868 | B1 * | 4/2003 | Moulard | 102/201 |
| 7,201,103 | B1 * | 4/2007 | Englund | 102/201 |
| 7,204,190 | B2 * | 4/2007 | Englund | 102/201 |
| 2004/0123763 | A1 * | 7/2004 | Englund | 102/201 |
| 2007/0044672 | A1 * | 3/2007 | Smith | 102/201 |

* cited by examiner

*Primary Examiner*—Bret Hayes
(74) *Attorney, Agent, or Firm*—John F. Moran

(57) ABSTRACT

An explosive primer responsive to optical energy is constructed from an energetic composition optically coupled to an optical power source by a pigtailed optical fiber. The pigtailed portion of the optical fiber is positioned proximate to the energetic composition such that optical power emitted preferably by a laser diode initiates the detonation of the energetic composition thereby further initiating an additional, sympathetic detonation.

7 Claims, 6 Drawing Sheets

LASER PRIMER

UNITED STATES GOVERNMENT INTEREST

The inventions described herein may be manufactured, used and licensed by or for the U.S. Government for U.S. Government purposes.

FEDERAL RESEARCH STATEMENT

The invention described herein may be made, used, or licensed by or for the United States Government for government purposes without payment of any royalties thereon or therefore.

FIELD OF THE INVENTION

This invention relates generally to the field of explosives and pyrotechnics. More particularly, it pertains to an optically-initiated primer device.

BACKGROUND OF THE INVENTION

Primary detonators, or primers, are widely employed in mining, quarrying, warfare and other application areas to initiate the explosion of a more powerful secondary explosive, such as an artillery shell or firework. Primers are typically placed adjacent to, or within, a secondary explosive such that explosive energy produced by detonation of the primer causes the secondary explosive to detonate.

More sophisticated explosive systems include primers that are detonated by the application of mechanical, electrical or magnetic energy. This energy is often conveyed to the primer by electrical conductors or a shock tube. Still other contemporary primers are detonated by thermal or electrical energy generated by a transducer attached to the primer. With such primers, a wireless signal is sent to the transducer, which then initiates the detonation of the primer.

A primer whose detonation is initiated by thermal, electrical or magnetic mechanisms however, is susceptible to unintended detonation. For example, inadvertent primer detonation due to stray electrical discharge—such as Personnel Electrostatic Discharge (PESD) or lightning strike—are well-known. In addition, primers configured to detonate in response to wireless signals are particularly susceptible to inadvertent detonation as a result of stray radio-frequency signals or those generated by hostile forces.

As a result, a primer that exhibits both reduced susceptibility to unintended detonation and reliable intended detonation would represent a significant advance in the art.

SUMMARY OF THE INVENTION

In accordance with the principles of the instant invention, a primer for detonating an explosive is constructed, wherein the primer is detonated by optical stimulation. In an illustrative embodiment, the primer includes an energetic composition that detonates when subjected to optical energy above a predetermined power threshold. A laser that emits optical energy above that pre-determined threshold is optically coupled to the primer via an optical fiber having a pigtailed portion. In response to the incident optical energy, the primer detonates. When the primer is placed in sufficiently close proximity to another explosive and detonated, the detonation of the primer causes the sympathetic detonation of the explosive.

According to the invention, the laser primer includes a housing containing an energetic composition in optical communication with a source of optical energy, i.e., a laser. This optical communication between the primer energetic composition and the laser is effected by an optical fiber from which any jacket or other covering has been stripped or otherwise removed and positioned within, or sufficiently proximate to the primer energetic composition. An end of the optical fiber opposite the stripped end may include a connector, for efficiently coupling optical energy into the optical fiber. Finally, portions of the optical fiber not proximate to the primer energetic composition may remain jacketed—thereby providing environmental and mechanical stability to the primer.

According to the invention, when the primer energetic composition exhibits sufficient pyrotechnic character, it may advantageously be used in training or simulation exercises. When used in conjunction with additional explosive compositions, it may be used to detonate the additional explosive. Advantageously, amounts of explosive compositions may be contained within the primer along with the primer energetic composition thereby providing additional explosive energy to the primer detonation for use with certain additional, insensitive explosives. In certain alternative embodiments, the primer may be mounted on a multi-axis positioner that selectively aligns a laser to the primer.

BRIEF DESCRIPTION OF THE DRAWING

Particular features and aspects may be understood with reference to the drawing in which.

DETAILED DESCRIPTION

The following merely illustrates the principles of the invention. It will thus be appreciated that those skilled in the art will be able to devise various arrangements which, although not explicitly described or shown herein, embody the principles of the invention and are included within its spirit and scope.

Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that the diagrams herein represent conceptual views of illustrative structures embodying the principles of the invention.

Figure 1:
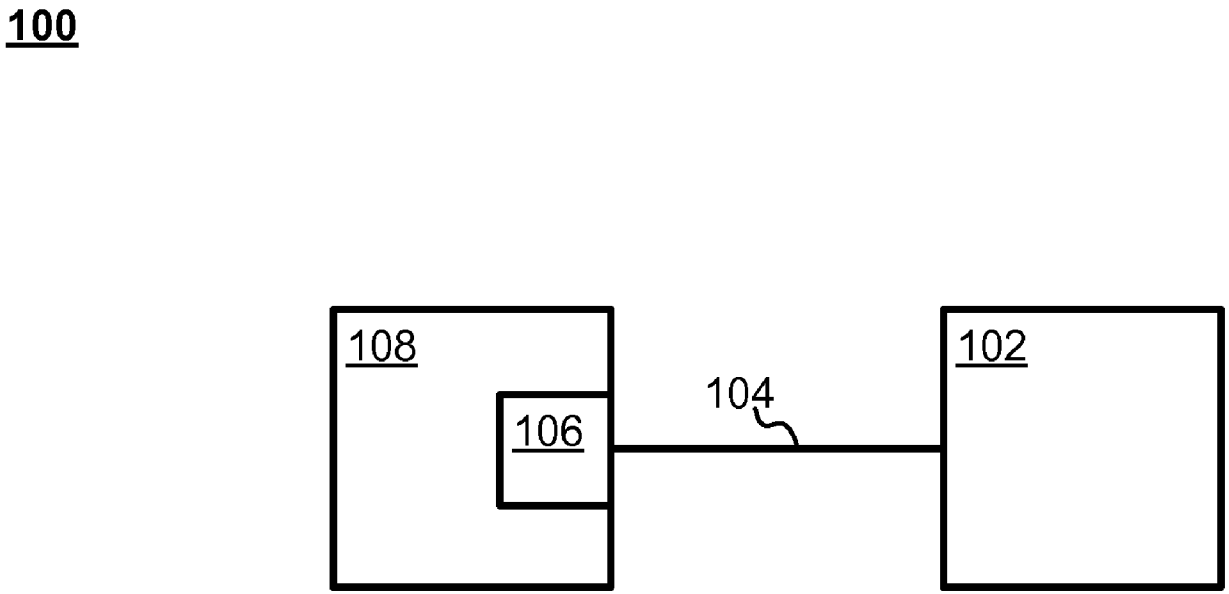
FIG. 1 (Prior Art)
FIG. 1 depicts a schematic diagram of a prior art explosive system.

FIG. 1 is a schematic diagram of a prior art explosive system. As shown, explosive system 100 includes a trigger mechanism 102, an explosive material 108, a primer 106 containing a primer energetic composition (not specifically shown) and a conduit 104, which connects the primer to the trigger mechanism 102 in such a manner that an actuation of the trigger mechanism 102 initiates detonation of the primer energetic composition contained within the primer 106.

The primer 106 is positioned within or sufficiently close to the explosive material such that the detonation of the primer 106 initiates the further detonation of the explosive 108. Operationally, when the trigger mechanism 102 is activated, the conduit 104 conveys a stimulus produced by the activation of the trigger mechanism 102 to the primer 106. When the stimulus reaches the primer 106, the primer 106 detonates which, in turn stimulates the explosion of the explosive 108.

Figure 2:
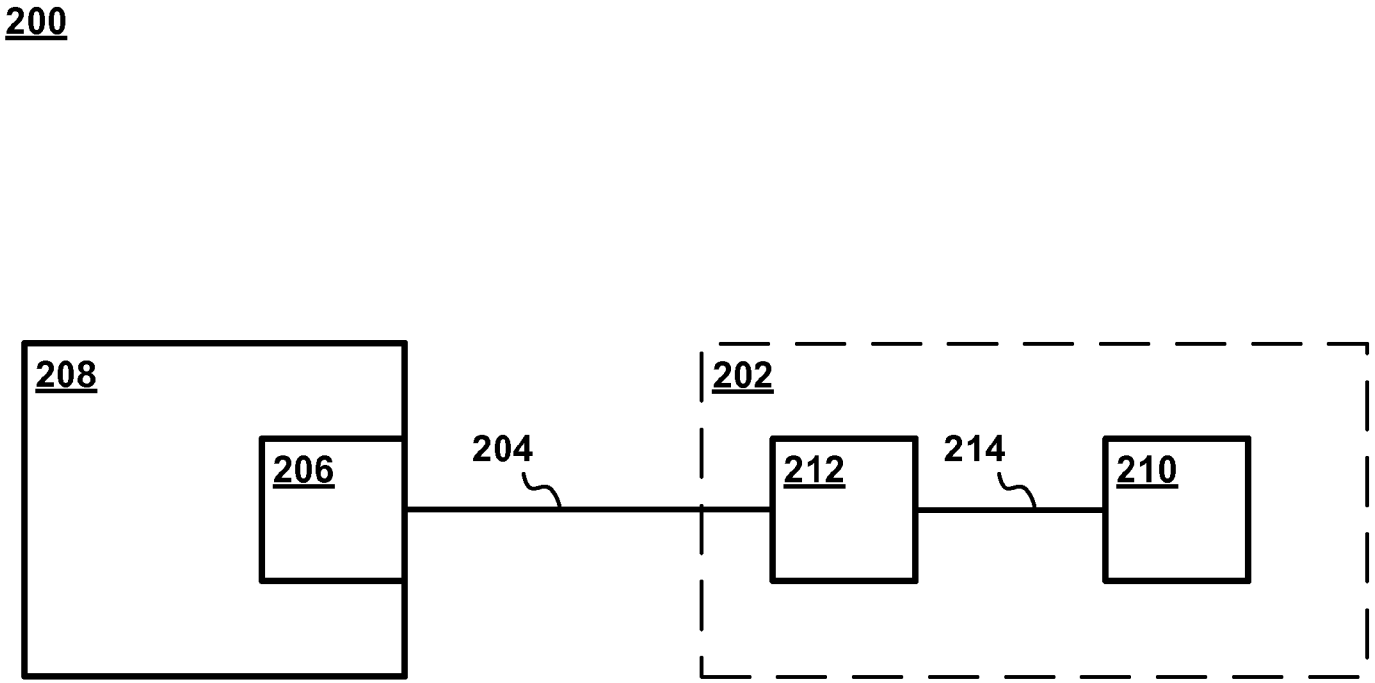
FIG. 2 depicts a schematic diagram of an explosive system according to the instant invention.

FIG. 2 depicts a schematic diagram of an illustrative explosive system according to the instant invention. Explosive system 200 comprises trigger mechanism 202, which is optically-coupled to primer 206 via conduit 204. Primer 206 is shown encased within explosive 208. Trigger mechanism 202 stimulates primer 206 with optical energy conveyed from trigger mechanism 202 to primer 206 via conduit 204. Primer 206 detonates when stimulated by sufficient optical energy, thereby stimulating the further detonation of explosive 208.

As depicted, the trigger mechanism 202 comprises a controller 210 and optical source 212. Advantageously, the controller 210 may be a general purpose processor and laser power supply. Upon receipt of a detonation command—which may be remotely provided—controller 210 supplies source 212 with electrical power via cable 214 thereby causing source 212 to emit optical energy at a power level sufficient to stimulate primer 206 to detonate. As can be readily appreciated by those skilled in the art, alternative embodiments wherein the controller 210 optionally includes timing circuitry and/or security devices and/or software to avoid inadvertent or unauthorized detonation of explosive 208.

According to the present invention, the optical source 212 may be a common, commercially available laser such as a solid-state laser diode. Cable 214 necessarily comprises electrical conductors exhibiting suitable electrical characteristics to convey sufficient electrical energy to optical source 212. As a matter of design choice, alternative embodiments of the trigger may also utilize cable 214 to convey command and/or control signals to the optical source 212.

According to the present invention, primer 206 includes an optically-sensitive, energetic composition, which is sufficiently explosive when subjected to an optical stimulus exhibiting a suitable power, i.e., ~1 Watt. In addition, a preferred primer is substantially immune to thermal stimulus, electrical stimulus, radio-frequency energy stimulus, and/or mechanical stimulus. In the illustrative embodiment, a primer 206 may include any of a number of known energetic compositions and/or materials and it may be positioned within, or sufficiently close to explosive 208 such that the explosive energy generated by the detonation of the primer 206 is sufficiently transferred to the explosive 208.

Conduit 204 is an optical fiber cable suitable for conveying optical energy that may exceed 1 Watt of power. The conduit 204 is optically-coupled both to the primer 206 and the source 212. As can be readily understood, the conduit 204 conveys optical energy emitted by the source 204 to the primer 206.

Figure 3:
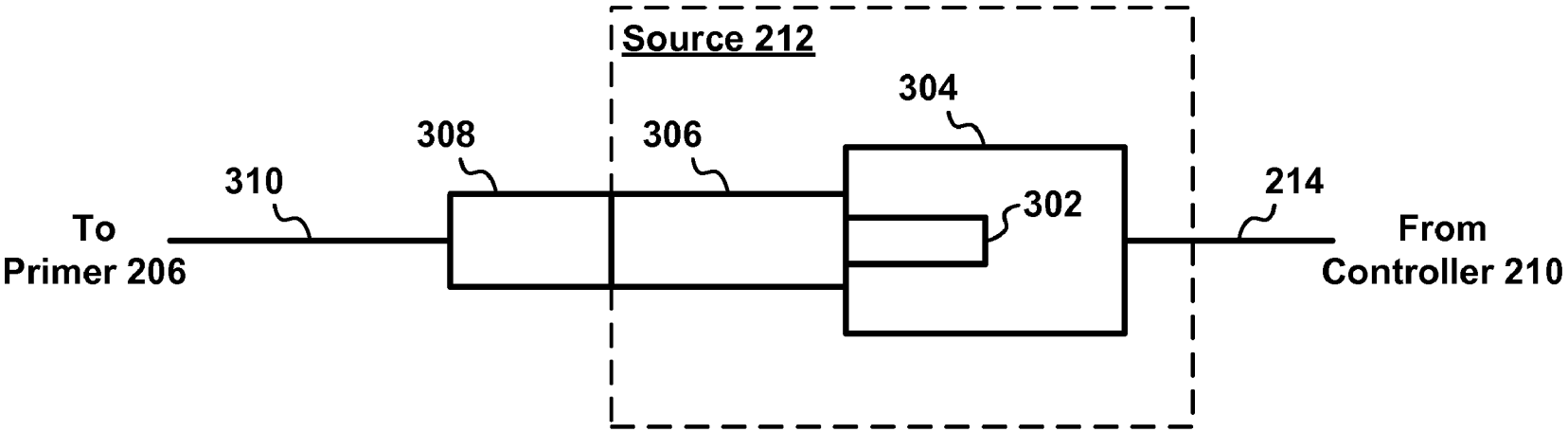
FIG. 3 depicts a schematic diagram of a source of optical energy according to the instant invention.

Turning now to FIG. 3, there it shows a schematic diagram of an optical source which may be employed with the present invention. As shown in this illustrative schematic, the optical source 212 comprises a laser 302, a laser mount 304, and an optical connector 306.

As can be readily appreciated, the Laser 302 may be any of a number of commercially available, relatively high-power laser diodes capable of outputting sufficient optical power, i.e., ~1 Watt or more. One requirement of the output optical energy emitted by the laser 302 is that it is sufficient and suitable for initiating the detonation of the primer 206. A collimating lens, (not specifically shown) for collimating the optical output of the laser 302, may be optionally provided.

The Laser mount 304 provides mechanical stability and heat dissipation for the laser 302 while the optical connector 306 facilitates the coupling of light output from the laser 302 into the optical fiber 310 via mating connector 308.

As can be readily appreciated by those skilled in the art, alternative embodiments may utilize configurations in which the optical fiber 310 is directly butt-coupled to laser 302 in a well-known fashion.

Figure 4:
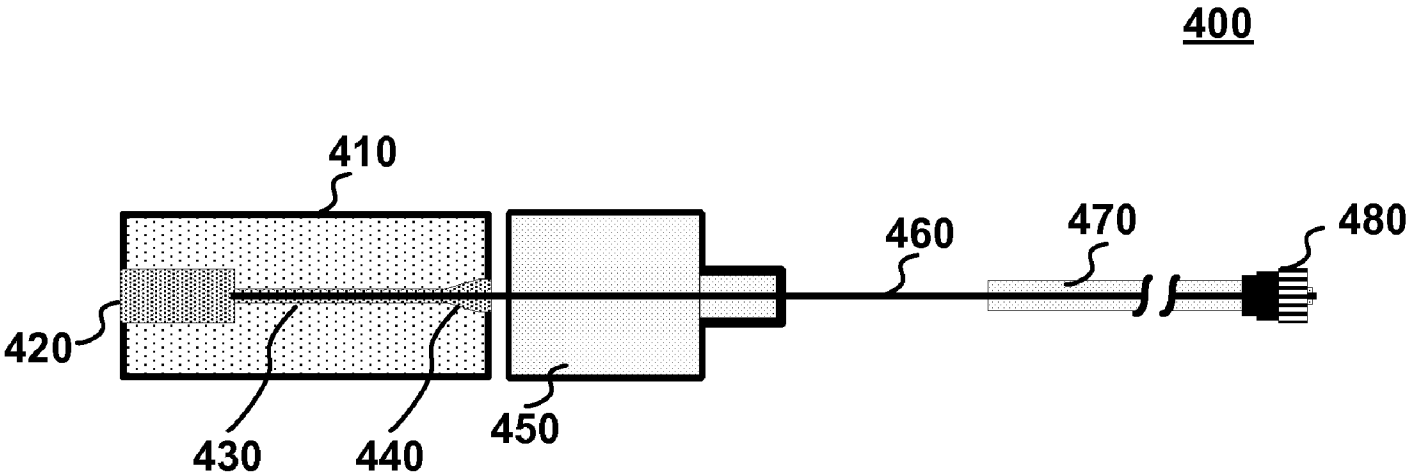
FIG. 4 is a schematic of a representative laser primer according to the present invention.

FIG. 4 is a schematic of a representative laser primer 400 according to the principles of the present invention. As will become apparent, this representative primer 400 offers a number of advantages namely, 1) it does not require a focusing device; 2) it does not require precise alignment; 3) it operates with low power and low cost laser diode; 4) it detonates with relatively low laser energy input; and 5) can withstand extreme environmental conditions including temperature, weather and energetic operations.

As can be observed from this FIG. 4, the primer 400 includes a housing 410 containing a primer energetic composition 420. Advantageously, the housing 410 may be constructed from any of a variety of materials such as polycarbonates or other plastics.

Positioned within the housing in a preferred embodiment is a conical receiver 440 which is mechanically interconnected to the energetic composition 420 by conduit 430. As can be readily appreciated by those skilled in the art, the conical receiver 440 facilitates the insertion of a portion of an optical fiber 460 from which a jacket 470 has been stripped. In this manner, the stripped optical fiber 460 is inserted into the conical receiver 440 and inserted further through the conduit 430 until it contacts or is sufficiently close to the primer energetic composition 420.

Alternatively, and as can be further appreciated by those skilled in the art, the primer energetic composition 420 positioned within the housing 410 may be preferably shaped at one end to efficiently receive optical energy output from optical cable 460. In other words, the energetic composition 420 itself may be shaped to facilitate receiving the stripped optical fiber 460. When constructed in this manner, the conical-shaped energetic composition—upon receipt of sufficient optical energy—initiates energetic action which is transferred by further primer energetic composition main energetic composition 420. In such an embodiment, the conical receiver 440, conduit 430, and primer energetic composition 420 are effectively constructed from the same primer energetic material.

Of course, such an embodiment is only exemplary and used to demonstrate a number of aspects of the present invention. Those skilled in the art will of course readily appreciate that just the main energetic composition itself 420 may be suitably shaped to receive the optical cable 460 and provide locus for pyrotechnic initiation.

As noted earlier, the optical cable 460 is stripped of its jacket 470 for a sufficient length to permit/facilitate insertion thereby providing a close proximity to the energetic composition 420. This stripped optical cable is mechanically secured to that proximate location near the energetic composition 440 and the housing 410 through the effect of strain boot 450 which, in a preferred embodiment, may be constructed from heat-shrinkable tubing or other known weather-resistant, mechanically sufficient materials.

At an end of the optical cable opposite to the fiber "pig tail" 460 described above that is inserted into the energetic composition 440, is preferably a connector 480 i.e., an SMA905 that permits the coupling of optical energy received from an optical energy source such as a laser diode (not specifically shown). Interposed between the connector 480 and the pig tail 460 is preferably a length of jacketed or otherwise protected optical cable 470. As can be readily appreciated by those skilled in the art, the particular length of jacketed optical cable 470 and the particular connector 480 is a matter of design choice and a variety of lengths and types are contemplated as being within the scope of the present invention. And while the length of the stripped optical cable pig-tail 460 is also variable, its stripped length must be sufficient to be inserted proximate to the energetic composition 420 that receives optical energy emitted therefrom.

Advantageously, the primer 400 may be used with a variety of different types of laser modules which serve as an optical power source, although solid-state laser diodes having an output power of substantially 1-watt have been found to be satisfactory. Such laser diodes offer the added benefits of relatively low cost, high reliability and mechanical and environmental robustness.

Still further, the reliable pigtail configuration shown in this FIG. 4 that embeds a stripped optic fiber in a pyrotechnic composition eliminates any need for a laser focuser and other associated precision optical alignment.

In evaluations of laser primers such as that shown in FIG. 4, a 1-watt/980 nm diode laser module successfully initiated test primers over temperature extremes—from 160° F. to −50° F. During these evaluations, optical energy of substantially 90 milli-joules or above was delivered from the diode laser to the laser primer pyrotechnic.

Preferred pyrotechnic compositions have been found to include those requiring less than 90 milli-joules of optical energy to initiate. Compositions having 1) Charcoal (14%), Sulfur (10%), Potassium Nitrate (71%), and Elvax® 260 (5%) (Registered Trademark of the DuPont Company) or 2) Boron (22%), Potassium Nitrate (73%), Elvax 260 (5%) have been determined to be particularly useful. Elvax 260, a tradename for ethylene vinyl acetate (EVA) resins, is a preferred binder for these compositions. Other suitable binders include Elvax 265, Elvax 360 or vinyl alcohol acetate resin(s) (VAAR).

Finally, during the evaluations an optical cable having an optical fiber of 200 microns or less was found to minimize laser optical energy dispersion while providing sufficient initiation energy. The Numerical Aperture was approximately 0.22.

Figure 5:
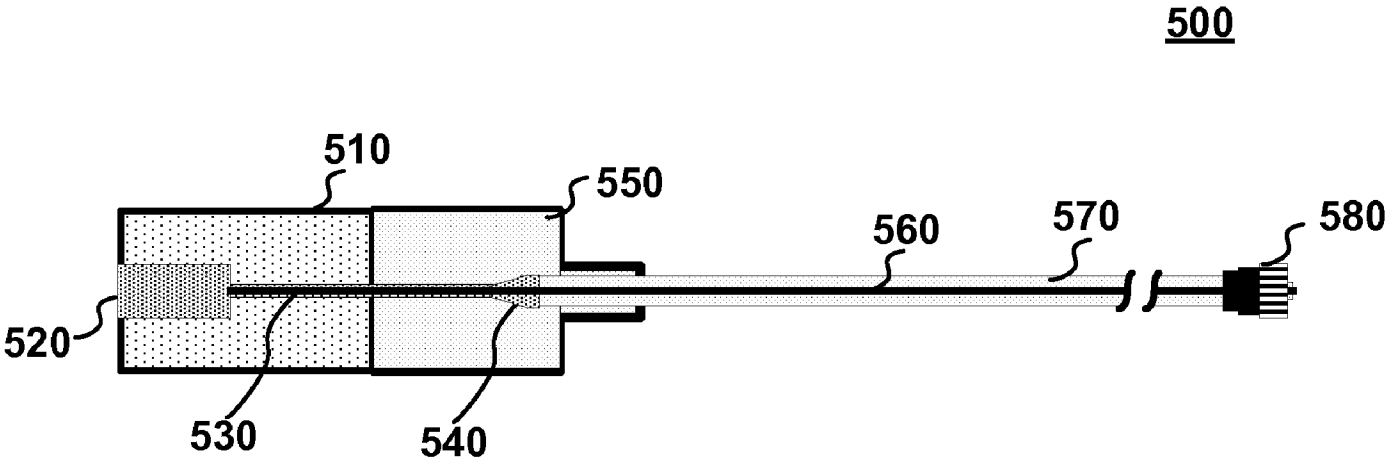
FIG. 5 is an additional schematic of the representative laser primer of FIG. 4 constructed according to the present invention.

Turning now to FIG. 5, there is shown an alternative embodiment of the primer depicted in FIG. 4, wherein the strain boot 550 is now shown engaging the housing 510 thereby securing the optical fiber 560 from which is stripped a portion of the jacket 570, in a fixed position proximate to primer energetic composition 520. In this example, the stripped fiber 560 is inserted or "threaded" through conical receiver 540 and conduit 530 such that its end is sufficiently close to the energetic composition 520.

Finally, it is noted that in certain applications a primer having substantially more or different detonation characteristics may be desired. More particularly, and as can be readily appreciated, additional compositions may be added to the primer(s) shown to provide such different detonation characteristics. By way of example, additional compositions may be added to the primer to give a detonation particular light or color characteristics. In this manner, the primer device may act as a pyrotechnic suitable for training or exercise purposes.

When added additional compositions are particularly energetic or explosive, a primer having additional detonation capability (power) is constructed and may be suitable for detonation of state-of-the-art insensitive munitions or other explosives.

Figure 6:
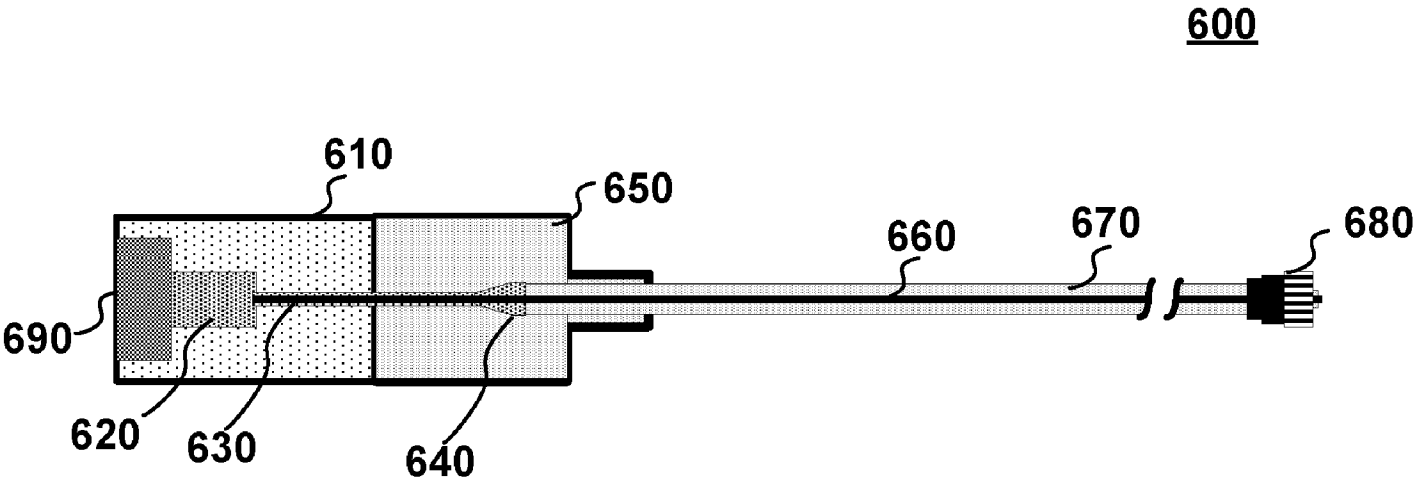
FIG. 6 is an alternative embodiment of a laser primer of the present invention that includes an additional explosive composition.

Such an alternative embodiment is shown schematically in FIG. 6. In particular, an additional explosive composition 690 is shown positioned adjacent to primer energetic composition 620 such that the explosive 690 is further detonated upon detonation of the primer energetic composition 620. As noted before, when this additional explosive composition (of which any of a variety of known explosives may be used) is detonated by an initial detonation of the primer energetic composition 620, such detonation provides additional energy or effects to the primer detonation suitable for example, detonating additional high explosives.

It is to be understood that the above-described embodiments are merely illustrative of the instant invention and that many variations of the above-described embodiments can be devised by those skilled in the art without departing from the scope of the invention. For example, in this Disclosure, numerous specific details are provided in order to provide a thorough description and understanding of the illustrative embodiments of the instant invention. Those skilled in the art will recognize, however, that the invention can be practiced without one or more of those details, or with other methods, materials, components, etc.

What is claimed is:

1. A laser primer for comprising:

an energetic composition;

a source of optical power;

a length of optical fiber having a pigtailed portion for optically connecting the optical power source to the energetic composition;

a housing containing the energetic composition;

a substantially conical shaped receiver for receiving the pigtailed portion of the optical fiber;

a conduit for providing a pathway from the receiver to the energetic composition and into which is inserted the pigtailed portion of the optical fiber;

a shaped portion of energetic composition into which the pigtailed portion of the optical fiber is positioned;

a connector affixed to an end of the optical fiber opposite the pigtailed portion for selectively coupling the optical fiber to the optical power source;

a strain boot for securing the optical fiber to the housing;

wherein the pigtailed portion of the optical fiber has any jacket or other coverig removed and is positioned sufficiently proximate to the energetic composition such that the optical power is conveyed to the energetic composition thereby initiating its detonation;

and wherein said energetic composition is one selected from the group consisting of potassium nitrate energetic and boron energetic;

wherein said potassium nitrate energetic consists of by weight, 14% charcoal, 10% sulfur, 71% potassium nitrate and 5% binder wherein said binder is one selected from the group consisting of: Elvax 260, Elvax 265, Elvax 360, vinyl alcohol acetate, and ethylene vinyl acetate; and wherein said boron energetic consists of by weight 22% boron, 73% potassium nitrate and 5% binder wherein said binder comprises one selected from the group consisting of an ethylene vinyl acetate and a vinyl alcohol acetate.

2. The laser primer of claim 1 wherein said source of optical power is a laser diode.

3. The laser primer of claim 2 wherein said laser diode produces an optical power of at least 1 watt.

4. The laser primer of claim 1 wherein the detonation of said energetic composition is initiated upon receipt of optical power less than 90 milli-joules.

5. The laser primer of claim 1 further comprising additional energetic composition.

6. The laser primer of claim 5 wherein said additional energetic composition comprises a high explosive material.

7. The laser primer of claim 1 wherein said additional energetic composition exhibits pyrotechnic characteristics.

* * * * *